United States Patent [19]

Nakanishi et al.

[11] Patent Number: 5,052,041

[45] Date of Patent: Sep. 24, 1991

[54] SILENCER

[75] Inventors: Keiji Nakanishi, Takatsuki; Yasuyuki Sekiguchi, Ibaraki, both of Japan

[73] Assignee: Kabushiki Kaisha Toshiba, Kawasaki, Japan

[21] Appl. No.: 485,563

[22] Filed: Feb. 27, 1990

[30] Foreign Application Priority Data

Feb. 27, 1989 [JP] Japan ..... 1-46111

[51] Int. Cl.[5] ..... G10K 11/16

[52] U.S. Cl. ..... 381/71

[58] Field of Search ..... 381/71, 94

[56] References Cited

U.S. PATENT DOCUMENTS 4,559,828 12/1985 Liszka ..... 340/870.28

FOREIGN PATENT DOCUMENTS 2201858 9/1988 United Kingdom .

OTHER PUBLICATIONS

Bleazey, J. C., Electronic Sound Absorber, JAES, Apr., 1962, vol. 10, No. 2, pp. 135–139.

*Primary Examiner*—Forester W. Isen

*Attorney, Agent, or Firm*—Cushman, Darby & Cushman

[57] ABSTRACT

A silencer for refrigerators includes a microphone for detecting noise produced by a compressor disposed in a machine compartment and converting the noise to an electrical signal, a signal converter converting the electrical signal generated by the microphone to a corresponding sound wave signal suitable for deadening the noise from the compressor by the effect of the sound wave interference, a speaker driven in response to the sound wave signal generated by the signal converter such that the sound is directed to the interior of the machine compartment of the refrigerator, a storage for previously storing data of noise patterns of the compressor in the abnormal condition of an evaporator as reference patterns, and a control comparing the electrical signal generated by the microphone with the data of the reference noise patterns stored in the storage, thereby determining as to whether or not the evaporator is abnormal.

12 Claims, 6 Drawing Sheets

SILENCER

BACKGROUND OF THE INVENTION invention relates to a silencer for deadening noise produced from a refrigerant compressor of a refrigeration system by the effect of sound wave interference.

Almost every home is generally furnished with refrigeration system such as a household refrigerator, which is in continuous operation throughout seasons. Such a household refrigerator has a problem of noise to be solved. In the refrigerator, one critical noise source is a machine compartment enclosing a compressor and piping system connected to the compressor. More specifically, from the machine compartment is emanating relatively big noise, for example, noise produced with drive of a compressor motor, noise produced with flowing of the compressed gas, and mechanical noise produced by moving members of a compression mechanism. Further, the piping system connected to the compressor produces noise due to vibration thereof. The noise emanating from the machine compartment thus accounts for a large part of noise of the refrigerator. Accordingly, control of noise from the machine compartment contributes to noise reduction in the refrigerator.

Conventionally, compressors of the low noise type such as a rotary compressor have been employed for the purpose of reducing noise emanating from the machine compartment. Further, the construction of vibration-proofing of the compressor has been improved and the configuration of the vibration in a vibration transmission path. Further, noise absorptive and insulative members have been disposed around the compressor and piping system, thereby improving an amount of noise absorbed in the machine compartment and a noise transfer loss.

However, a plurality of ventilating openings are formed in one or more of walls defining the machine compartment for ventilating the machine compartment, and the noise produced in the machine compartment is caused to leak outward through the ventilating openings. As the result of provision of the ventilating openings, the above-mentioned conventional noise-reduction methods each have a definite limit and provide with the noise reduction of 2 dB (A) at the most.

On the other hand, with advancement of applied electronics technique including sound data processing circuitry and acoustic control technique, application of a noise control wherein noise is deadened by the effect of sound wave interference has recently been taken into consideration. More specifically, in the above-mentioned noise control, sound generated by a noise source is received by a sound receiver such as a microphone disposed in a specific position and the sound receiver generates an electrical signal in accordance with the received sound. The electrical signal is then converted to a control signal by signal converting means. The control signal is supplied to a speaker so that an artificial sound of opposite phase or 180° out of phase with the noise received by the microphone and having the frequencies same as those and the amplitude same as that of the received sound is produced by the speaker, so that the artificial sound interferes with the received sound, thereby deadening the sound.

However, when such a noise control is applied to the refrigeration system such as a household refrigerator, parts of a silencer such as a microphone are employed for only the purpose of deadening noise and accordingly, the added value of the silencer is not so high from the point of the production cost thereof, which is desired to be solved.

SUMMARY OF THE INVENTION

Therefore, an object of the present invention is to provide a silencer for deadening noise produced by a refrigerant compressor in a refrigeration system by the effect of sound wave interference.

Another object of the invention is to provide a silencer for deadening noise produced by the refrigerant compressor in a refrigeration system, which silencer can be utilized for detecting abnormality in a refrigerating cycle based on the noise pattern of the compressor.

The silencer of the present invention is employed in a refrigeration system including an outer cabinet having a compartment, an evaporator for cooling a refrigerant, a compressor disposed in the compartment for compressing the refrigerant discharged from the evaporator, the compressor being driven by a motor enclosed therein, and a condenser for condensing the high pressurized refrigerant gas discharged from the compressor. The silencer prevents sound produced by the compressor from emanating from the compartment and comprises noise detecting means for detecting noise produced by the compressor and converting the noise to a corresponding electrical signal, signal converting means for converting the electrical signal generated by the noise detecting means to a corresponding sound wave signal suitable for deadening the noise from the compressor by the effect of the sound wave interference, a sound producer driven in response to the sound wave signal generated by the signal converting means such that the sound is directed to the interior of the compartment, storage means for previously storing data of noise patterns of the compressor in abnormality of the evaporator as reference patterns, and means for comparing the electrical signal generated by the noise detecting means with the data of the reference noise patterns stored in the storage means, thereby determining as to whether or not the evaporator is abnormal.

The noise produced by the compressor is detected and converted to a corresponding electrical signal by the noise detecting means such as a microphone. The electrical signal is further converted by the signal converting means to a sound wave signal having a waveform suitable for deadening the noise by the effect of the sound wave interference. The sound wave signal is supplied to the sound producer such as a speaker which produces sound interfering with the noise, thereby reducing the noise by the effect of the sound wave interference.

The storage means previously stores data of the reference patterns produced by the compressor in the abnormal condition of the refrigerating cycle in which the refrigerant is not sufficiently cooled. When the noise produced during operation of the compressor is detected and converted to the electrical signal by the noise detecting means, the electrical signal is compared with the reference patterns, thereby automatically determining whether or not the refrigerating cycle is in the abnormal condition. Thus, the noise detecting means is utilized for determining the abnormal condition of the refrigerating cycle as well as for the noise reduction and consequently, the production cost of the refrigeration system is reduced.

It is preferable that the data of reference patterns include data of the amplitude values of the noise in predetermined noise frequency ranges or data of the accumulated amplitude values of the noise in predetermined noise frequency ranges and the comparing means accumulates the amplitudes of the signals generated by the noise detecting means, the signals corresponding to the frequency ranges of the reference pattern, thereby comparing the accumulated amplitude value with the reference pattern. In the case where the data of reference patterns includes data of the accumulated amplitude values of the noise, the comparing means accumulates the amplitudes of the signals generated by the noise detecting means and corresponding to the frequency ranges of the reference pattern, thereby comparing the accumulated amplitude value with the reference pattern.

It is preferable that the refrigeration system further includes fan means for directing air to the circumference of the evaporator and a temperature sensor for sensing the temperature of the evaporator or the circumference thereof and that the data of the reference noise patterns includes data of noise patterns of the compressor in the case where the refrigerant has leaked out, data of noise patterns of the compressor in the case where the fan means has stopped, and data of noise patterns of the compressor in the case where the temperature sensor has been in an abnormal state.

It is preferable that the compressor compartment is defined by ceiling, bottom, side, front and rear walls and that one of dimensions of the depth, width and height of the compressor compartment has a value larger than the other two such that a standing wave of sound to be deadened is composed only in the direction of said one dimension having the value larger than the other two.

It is preferable that the compartment has a ventilating opening formed in at least one of the walls of defining the compartment and that the ventilating opening is formed into a generally slenderly rectangular shape so as to longitudinally intersect the direction in which the standing wave of the sound travels in the compartment.

Other objects of the present invention will become obvious upon an understanding of the illustrative embodiment about to be described or will be indicated in the appended claims, and various advantages not referred to herein will occur to one skilled in the art upon employment of the invention in practice.

DESCRIPTION OF THE PREFERRED EMBODIMENT

An embodiment in which the invention is applied to a household refrigerator will now be described.

Figure 3:
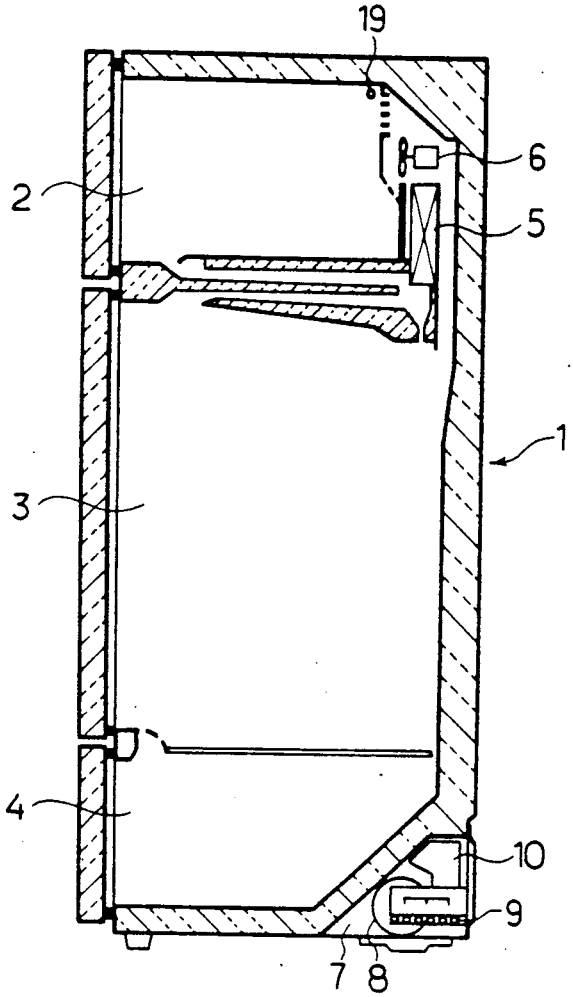
FIG. 3 is a longitudinal sectional view of a refrigerator to which the silencer is applied.

Referring first to FIG. 3 illustrating an overall construction of the refrigerator, reference numeral 1 designates a heat-insulative outer cabinet of the refrigerator. The interior of refrigerator cabinet 1 is partitioned to a freezing compartment 2, a storage compartment 3 and a vegetable compartment 4 from the top. An evaporator 5 is provided at the backside of freezing compartment 2. A fan 6 is provided for directly supplying chilled air to freezing and storage compartments 2 and 3. A machine compartment 7 serving as a compartment is provided at the lower backside of refrigerator cabinet 1. Machine compartment 7 is defined by ceiling, bottom, side walls and front and rear walls. Machine compartment 7 encloses a rotary compressor 8 enclosing a motor, a condenser pipe 9 and a defrost-water vaporizer 10 employing the so-called ceramic fins. While compressor 8 is being driven, a refrigerant is supplied from compressor 8 to evaporator 5, which cools the refrigerant and fan 6 is driven to perform the heat exchange between evaporation 5 and the refrigerator interior.

Figure 4:
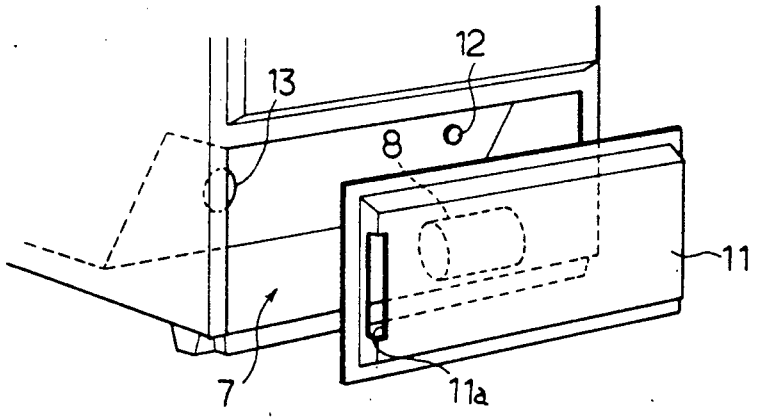
FIG. 4 is an exploded perspective view of the major part of the refrigerator.

As shown in FIG. 4 wherein condenser pipe 9 and defrost-water vaporizer 10 are eliminated, machine compartment 7 has at the backside a rectangular opening which is closed by a machine compartment cover 11 which is a front wall of machine compartment 7. In closing the opening of machine compartment 7, the periphery of cover 11 is air-tightly attached against the opening edge of machine compartment 7. A slenderly rectangular ventilating opening **11*a* extending vertically is formed in the left-hand edge portion of cover 11, as viewed in FIG. 4. Thus, when cover 11 is attached to machine compartment 7, the same is closed except ventilating opening 11*a*. Cover 11** is formed of a hard material having fine heat-conductivity and large sound-transfer loss property such a metal as steel.

A microphone 12 serving as a noise receiver is provided in machine compartment 7. Microphone 12 is disposed so as to be opposite to compressor 8 from the side opposite to ventilating opening **11*a* (the right-hand side, as viewed in FIG. 2). Microphone 12 generates an electrical signal in accordance with the sound received from compressor 8 as noise source. A speaker 13 serving as sound producing means is provided in machine compartment 7. Speaker 13 is mounted in a portion of an inner wall of machine compartment 7 corresponding to the bottom wall of refrigerator cabinet 1, the portion being in the vicinity of ventilating opening 11*a***.

Figure 1:
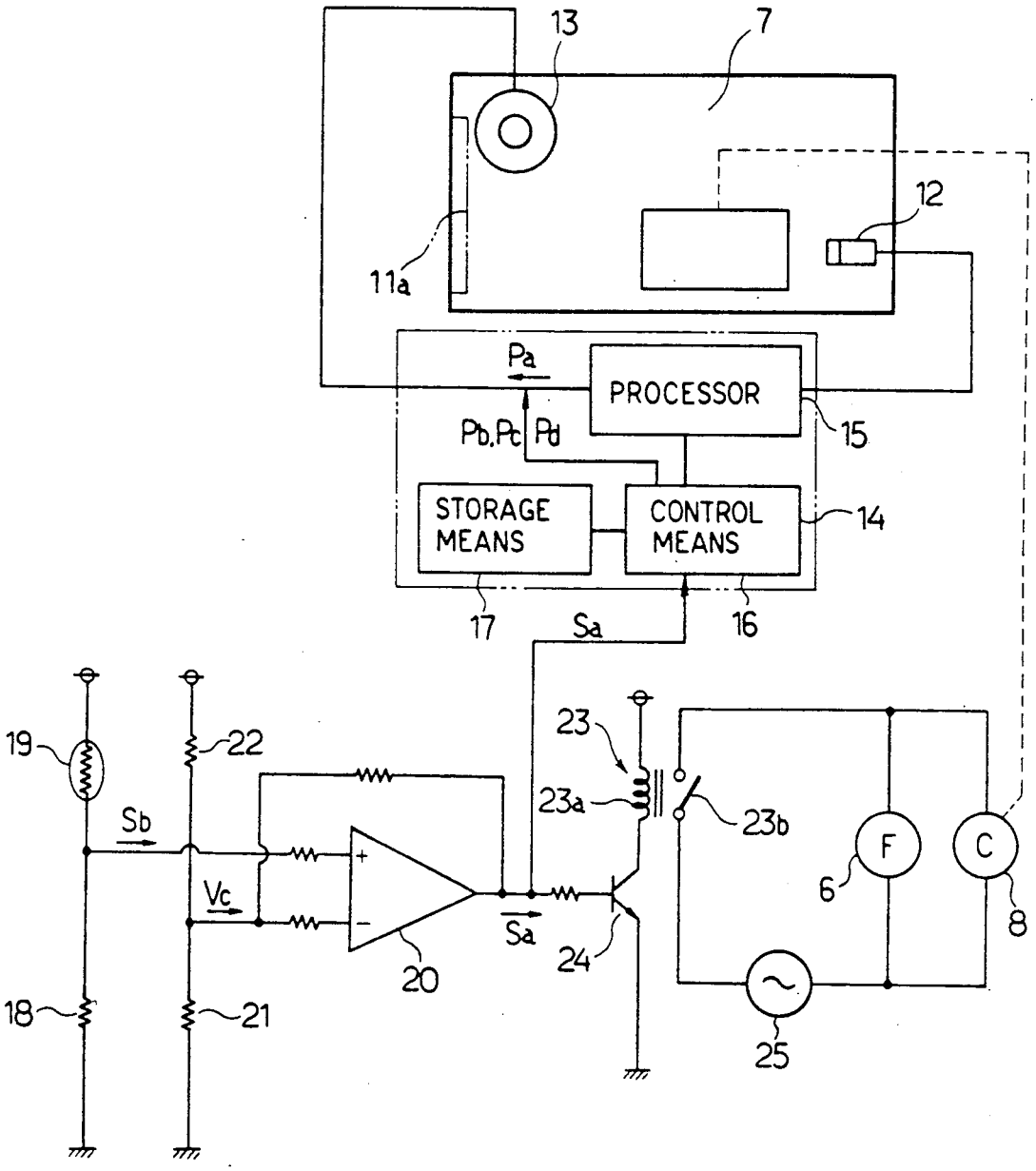
FIG. 1 is a schematic illustration of an electrical arrangement of a silencer of an embodiment in accordance with the invention.

Referring to FIG. 1, the electrical signal generated by microphone 12 is processed to a sound wave signal Pa by a processor 15 in an opposite-phase sound generating circuit 14. Sound signal Pa is supplied to speaker 13, which is operated. The above-described electrical signal processing is based on the principle of the sound deadening by the effect of sound wave interference as will be described hereinafter.

Figure 5:
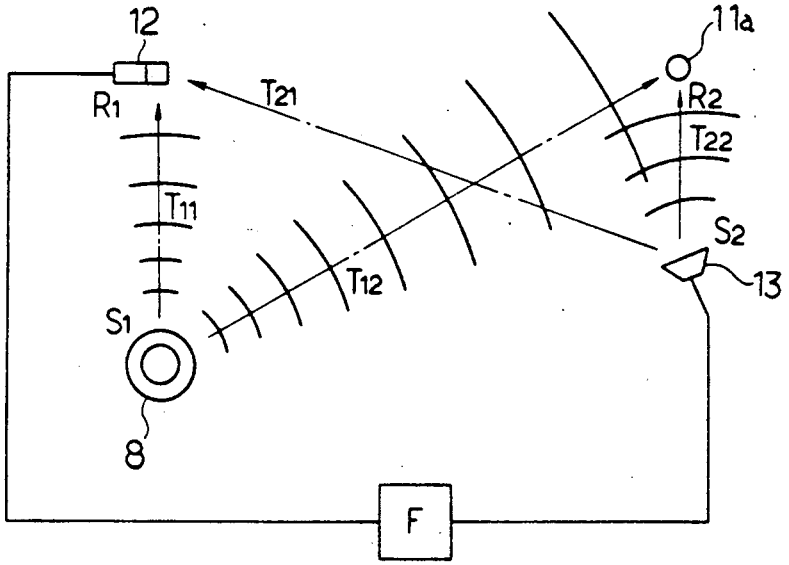
FIG. 5 is a schematic view illustrating the principle of deadening sound by the effect of sound wave interference.

Referring to FIG. 5, the following equation holds as two-input and two-output system:

$$\begin{bmatrix} R1 \\ R2 \end{bmatrix} = \begin{bmatrix} T11 & T21 \\ T12 & T22 \end{bmatrix} \begin{bmatrix} S1 \\ S2 \end{bmatrix}$$

where

S1=sound produced by compressor 8 as noise source

S2=sound produced from speaker 13

R1=sound received by microphone 12

R2=sound at ventilating opening 11*a* as control point

T11, T21, T12, T22=acoustic transfer functions between input and output points of the above sounds respectively Accordingly, sound S2 to be produced by speaker 13 is obtained by the following equation:

$$S2=(-T12 \cdot R1+T11 \cdot R2)/(T11 \cdot T22-T12 \cdot T21)$$

Since the goal is to reduce the acoustic level at ventilating opening 11*a* to zero, zero is substituted for R2 as follows:

$$S2=R1 \cdot T12/(T12 \cdot T21-T11 \cdot T22)$$

As is understood from the equation, in order to render R2 zero, sound R1 received by microphone 12 may be processed by a filter expressed by the following equation:

$$F=T12/(T12 \cdot T21-T11 \cdot T22)$$

Thus, if a processed sound S2 obtained is produced from speaker 5, the sound level at ventilating opening 11*a* can be theoretically rendered zero. Processor 15 is adapted to perform the above-described sound processing at a high speed and supply a sound wave signal Pa to speaker 13.

Figure 6:
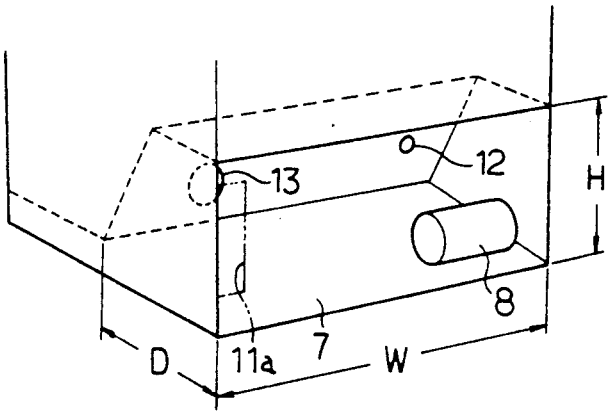
FIG. 6 is a schematic perspective view of the major part of the refrigerator for explaining the dimensions of the major part.

The inventors measured the level of noise produced with drive of compressor 8 in machine compartment 7 of the refrigerator constructed as described above. The level of noise produced with drive of compressor 8 in machine compartment 7 has a characteristic that the level is increased in the low frequency range below 700 Hz and in the high frequency ranges between 1.5 and 5 kHz. Of the noise of the respective ranges, the high frequency noise can be damped by way of sound transfer loss through machine compartment cover 11 or the like and dissipated by providing a sound absorption member in machine compartment 7. Accordingly, the noise reduction control by the above-described microphone 12, speaker 13 and processor 15 is aimed at the noise in the range below 700 Hz as a target frequency. In the above-described noise reduction control by way of the sound wave interference, it is important that the noise in machine compartment 7 be composed to be a one-dimensional plane traveling wave so that the noise control is performed theoretically and technically with ease and accuracy. In the embodiment, for example, the width W or transverse dimension of machine compartment 7 in FIG. 6 is determined so as to take a value larger than those of the depth D or front-to-back dimension and height H or longitudinal dimension thereof such that a standing wave of the sound in machine compartment 7 holds only for a primary mode. More definitely, the width W is determined to be 600 mm and each of the depth D and height H 200 mm. In other words, the dimension of width W is approximated to the wavelength of the sound to be deadened and the dimensions of depth D and height H are shorter than the wavelength of the sound to be deadened. When machine compartment 7 is considered a rectangular cavity, the following equation holds:

$$f = C \cdot \sqrt{(Nx/Lx)^2 + (Ny/Ly)^2 + (Nz/Lz)^2}\ /2$$

where f=resonant frequency (Hz)

Nx, Ny and Nz=fundamental waves and high frequency waves in the directions of X, Y and Z, respectively Lx, Ly and Lz=dimensions in the directions of X, Y and Y in machine compartment 7, that is, D, W and H, respectively C=sound velocity From the above equation, frequencies fx, fy and fz of standing waves of the fundamental waves in the respective directions of X, Y and Z can be obtained.

More specifically, when the depth D is determined to be 200 mm with the width W and height H 600 mm and 200 mm, respectively, the frequency fx of the standing waves of the fundamental wave in the direction of X can be obtained as:

$$\begin{aligned} fx &= 340\sqrt{(1/0.2)^2}\ /2 \\ &= 850 \text{ Hz} \end{aligned}$$

where

Ny=Nz=0

C=340 m/sec.

Similarly, frequencies fy and fz of the standing waves of the fundamental waves in the respective directions of Y and Z can be obtained as:

$$\begin{aligned} fy &= 340\sqrt{(1/0.6)^2}\ /2 \\ &= 283 \text{ Hz} \end{aligned}$$

$$\begin{aligned} fz &= 340\sqrt{(1/0.2)^2}\ /2 \\ &= 850 \text{ Hz} \end{aligned}$$

Consequently, the range below the target frequency (700 Hz), the standing wave of sound in machine compartment 7 holds in the mode of the direction of Y (direction of the width) and, therefore, the sound produced in machine compartment 7 may be considered a one-dimensional plane traveling wave. Consequently, the theoretical handling of the wave front can be rendered easy when sound is to be deadened by way of the noise reduction control in the use of speaker 13 and the like, and the silencing control can be performed with ease and accuracy.

Opposite-phase sound producing circuit 14 includes control means 16 as well as processor 15 for the noise reduction control, as shown in FIG. 1. Control means 16 determines whether or not the constituent elements of the above-described refrigeration system is normally operated. For execution of such determining function, control means 16 is supplied with a drive signal Sa which is also supplied to compressor 8.

An electrical circuit originally provided in the refrigerator is utilized as that for producing the drive signal Sa and compressor 8 and fan 6 are driven during output of the drive signal Sa. Circuit arrangements for these purposes will be briefly described with reference to FIG. 1. A thermistor 19 is connected in series to a resistance 18 for the purpose of sensing the temperature of freezing compartment 2 (also see FIG. 3). A temperature signal Sb indicative of the temperature of freezing compartment 2 is generated by thermistor 19. A comparator 20 compares temperature signal Sb with a reference voltage Vc produced from the common connection between resistances 21 and 22. When the level of temperature signal Sb is above the reference voltage Vc, comparator 20 generates a high level drive signal Sa. As described above, when the temperature of freezing compartment 2 is increased to a predetermined value, high level drive signal Sa is generated by comparator 20 as the level of temperature signal Sb is above the reference voltage Vc. High level drive signal Sa is supplied to the base of transistor 24 for driving relay 23. A relay coil 23*a* of relay 23 is arranged so as to be excited when transistor 24 is turned on. A relay switch 23*b* of relay 23 is closed when relay coil 23*a* is excited, thereby driving compressor 8 and fan 6 to which commercial AC power supply 25 is connected.

Figure 7:
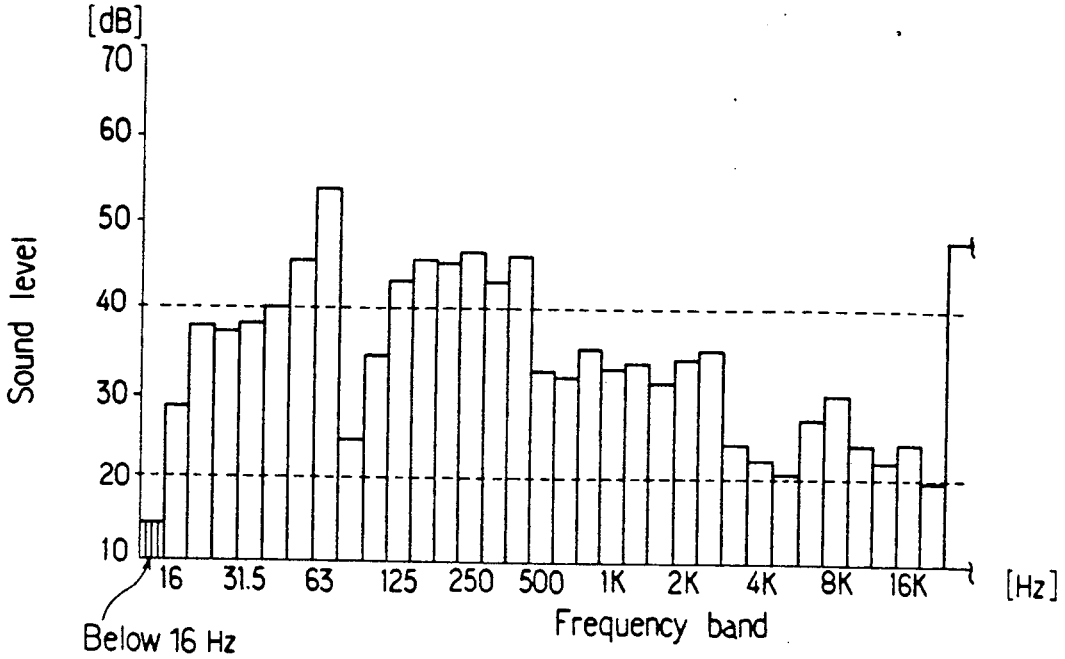
FIG. 7 illustrates frequency characteristics of the noise received when a fan is not locked.
Figure 8:
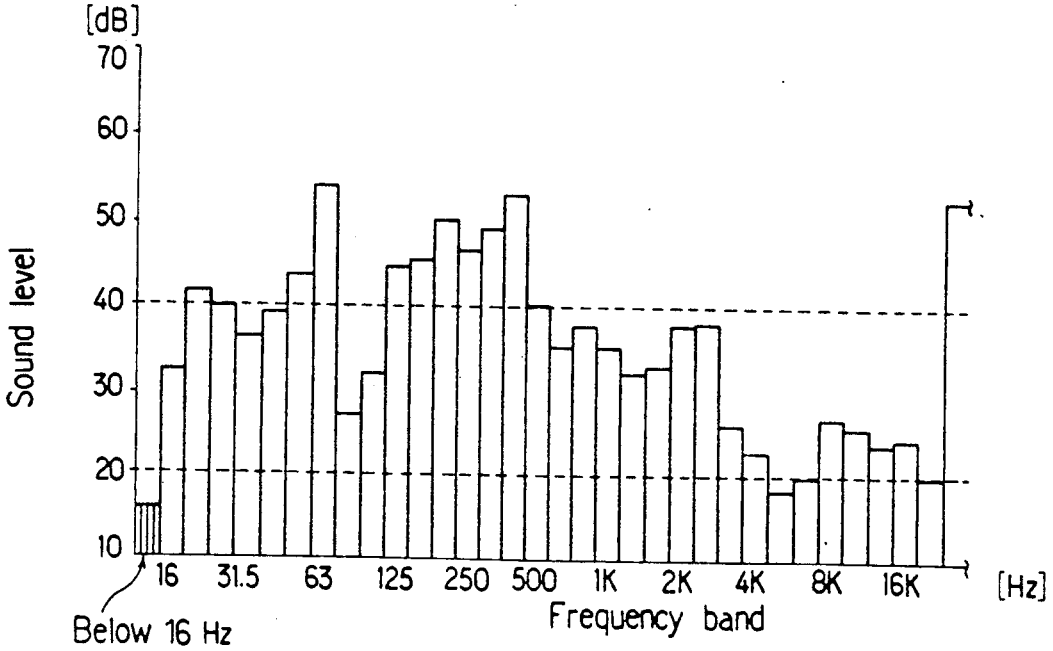
FIG. 8 is a view similar to FIG. 7 when the fan is locked.
Figure 9:
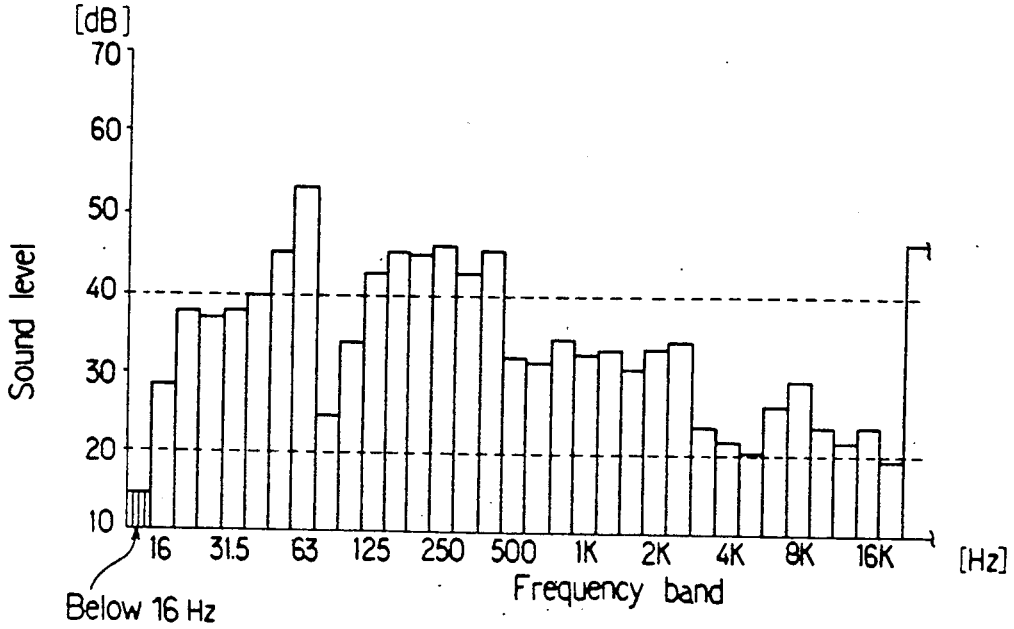
FIG. 9 illustrates frequency characteristics of the noise received while the refrigerant is not leaking.

Based on input of drive signal Sa, timing operation of a built-in timer (not shown), a built-in spectrum analyzer (not shown) and the reference received noise frequency characteristics the data of which is previously stored in storage means 17, control means 16 determines whether or not the refrigerating cycle constituent elements are in the undesired or abnormal conditions such as failure of thermistor 19, the locked condition of fan 6 (which is not driven although energized), leakage of the refrigerant from the refrigerant path and the like. More specifically, the electrical signal from microphone 12 is input to control means 16 through processor 15. The received noise frequency characteristics of the electrical signal is analyzed by the built-in spectrum analyzer. The obtained frequency characteristics are compared with the reference frequency characteristics the data of which is stored in storage means 17. When a predetermined difference is between both frequency characteristics, control means 16 determines that one or more of the refrigerating cycle constituent elements are in the undesired or abnormal condition, based on the difference. In this respect, the reference frequency characteristics the data of which is previously stored in storage means 17 correspond measured frequency characteristics of electrical signal from microphone 12 in the case of the undesired or abnormal conditions of the refrigerating cycle where the fan is locked with compressor 8 driven and where the refrigerant leaks with compressor 8 driven, as shown in FIGS. 7 to 9, respectively. More specifically, data of the sound level at every frequency band (at every ⅓ octave) is previously stored in storage means 17. When determining that any one of the constituent elements of the refrigerating system is in the undesired or abnormal condition, control means 16 generates alarm signals Pb, Pc and Pd. When alarm signal Pb is generated by control means 16, for example, a peeping alarm sound (continuous sound) is produced by speaker 13. When alarm signal Pc is generated by control means 16, an alarm sound (short intermittent sound) such as pip is produced by speaker 13. When alarm signal Pd is generated by control means 16, an alarm sound (long intermittent sound) such as intermittent peeping is produced by speaker 13.

Figure 2:
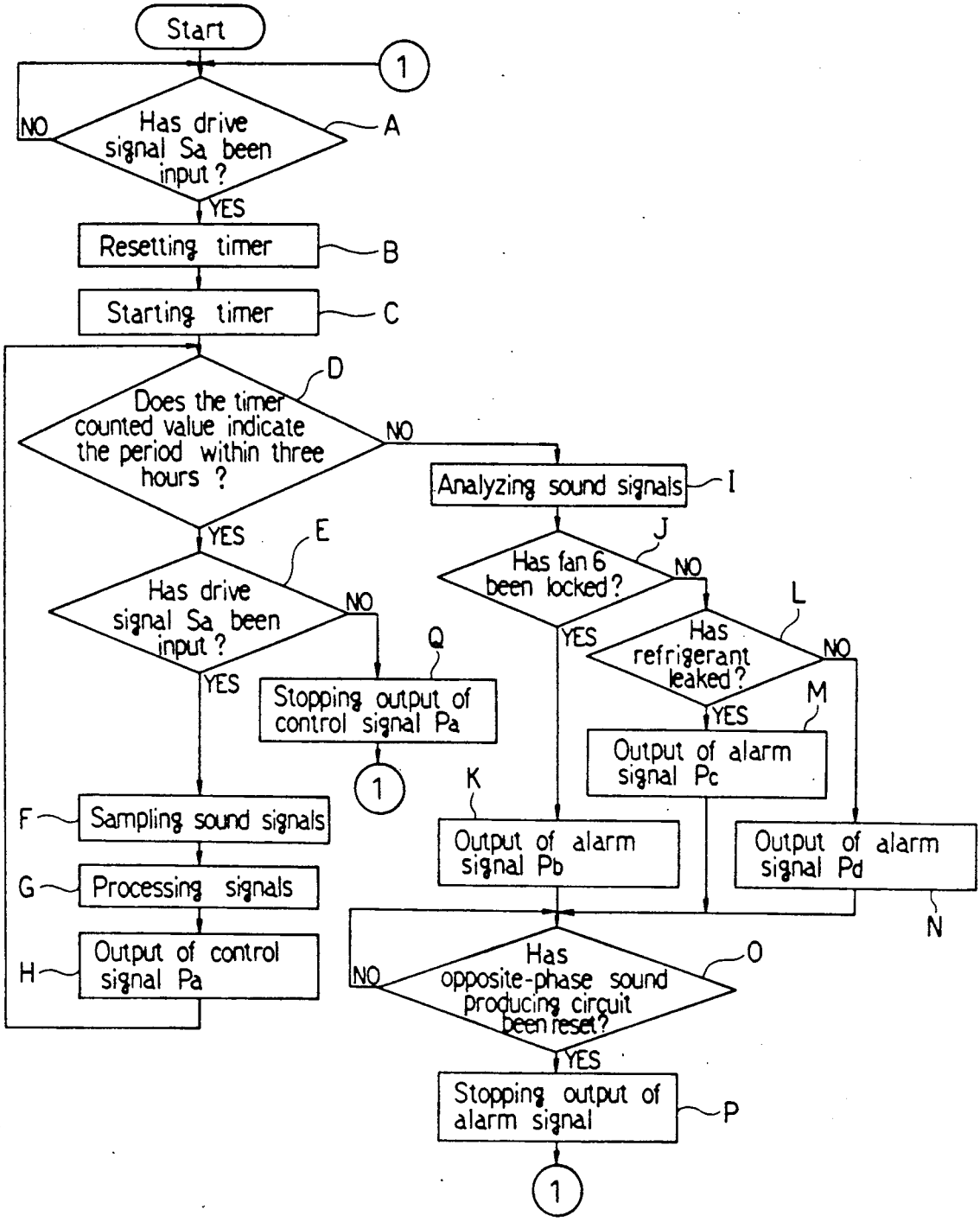
FIG. 2 is a flowchart of a control manner of an opposite phase sound producing circuit employed in the silencer.

Function of opposite-phase sound producing circuit 14, that is those of processor 15 and control means 16 will be described with reference to FIG. 2. When the level of the temperature signal Sb from thermistor 19 exceeds that of the reference voltage Vc with rise of the temperature of freezing compartment 2, drive signal Sa is generated by comparator 20 so that compressor 8 is driven. Since opposite-phase sound producing circuit 14 is in the standby mode until drive signal Sa is input, at step A, circuit 14 operates to reset the built-in timer when drive of compressor 8 starts, at step B and further to start the same at step C. When thermistor 19 and fan 6 are normally operated and the refrigerant does not leak from the refrigerant path, the storage compartment interior atmosphere is cooled and the level of temperature signal Sb from thermistor 19 is reduced. When timer counted value represents the period within three hours, opposite-phase sound producing circuit 14 advances from step D to step E and determines whether or not drive signal Sa has been input. When drive signal Sa is input, opposite-phase sound producing circuit 14 operates to sample sound signals from microphone 12 at step F and then operates to process the sampled sound signals based on the sound transfer functions at step G. A sound wave signal Pa obtained based on the sound signal processing is produced at step H. Thereafter, opposite-phase sound producing circuit 14 returns to step D. Sound wave signal Pa is supplied to speaker 13, which produces control sound. Consequently, the control sound is caused to interfere with the noise produced with drive of compressor 8 at ventilating opening 11*a*, thereby performing the sound reduction control. Opposite-phase sound producing circuit 14 repeats the routine from step D to step H so as to form a loop while drive signal Sa is input. Thus, since sound wave signal Pa is generated in accordance with the noise produced with drive of compressor 8 and supplied to speaker 13, the real-time noise control is executed. Consequently, even when components of noise from compressor 8 varies, such variations may be coped with and the noise may be reduced.

Now, consider the case that a long period operation of the refrigerating cycle causes occurrence of failure of thermistor 19 or fan 6 such that the refrigeration is not normally performed. When thermistor 19 is in the undesired and abnormal condition, for example, the level of temperature signal Sb from thermistor 19 is not lowered below that of reference voltages Vc for a long period even though the refrigerant supply by compressor 8 and the heat exchange by fan 6 are normally executed. In such a case, the storage compartment atmosphere is over-cooled as the refrigerating operation is excessively performed. On the other hand, when fan 6 is locked, the heat exchange is not performed by fan 6 even though thermistor 19 is normally operated and the refrigerant is normally supplied to evaporator 5. As a result, the storage compartment atmosphere is not sufficiently cooled. Furthermore, when the refrigerant is leaking from the refrigerant path, evaporator 5 is not supplied with sufficient amount of refrigerant even though both thermistor 19 and fan 6 are normally operated. As a result, the storage compartment atmosphere is not sufficiently cooled and accordingly, the storage compartment atmospheric temperature rises.

Opposite-phase sound producing circuit 14 detects and copes with the above-described undesired or abnormal conditions of the refrigerating cycle constituent elements in the following manner. When either thermistor 19 or fan 6 is in the undesired or abnormal condition as described above or when the refrigerant is leaking from the refrigerant path, temperature signal Sb from thermistor 19 is maintained at the level above that of reference voltage Vc for a long period since the storage compartment atmosphere is not sufficiently cooled. Accordingly, opposite-phase sound producing circuit 14 determines at step D that the timer counted value does not indicate the period within three hours, at the time the timer counts up the period of three hours, advancing to step I to thereby analyze the sound signal. More specifically, when a failure occurs in fan 6 or when the refrigerant is leaking from the refrigerant path, the frequency characteristics of the noise produced with drive of compressor 8 vary in accordance with the causes. By analyzing the noise frequency characteristics, opposite-phase sound producing circuit 14 determines for what cause compressor 8 is being driven for a long period. In this respect, the inventors measured the frequency characteristics of the noise produced with drive of compressor 8 to be received by microphone 12 in the locked condition of fan 6 and in the refrigerant leakage. The frequency characteristics measured are shown in FIGS. 8 and 10, respectively.

From comparison of the frequency characteristics in FIG. 8 with the reference frequency characteristics in FIG. 7 where fan 6 is normally operated, it is understood that the sound level in the locked condition of fan 6 is increased in the frequency band from 200 Hz to 2.5 KHz as compared in the unlocked condition thereof. It is considered that such increase in the sound level results from increase in compression ratio against the refrigerant with reduction of pressure at the suction side of compressor 8 due to insufficient evaporation of the refrigerant with insufficient heat exchange by evaporator 5. This confirms the fact that a major component of the noise in the frequency characteristics band from 500 Hz to 2 KHz is a pulsation sound of the refrigerant.

Figure 10:
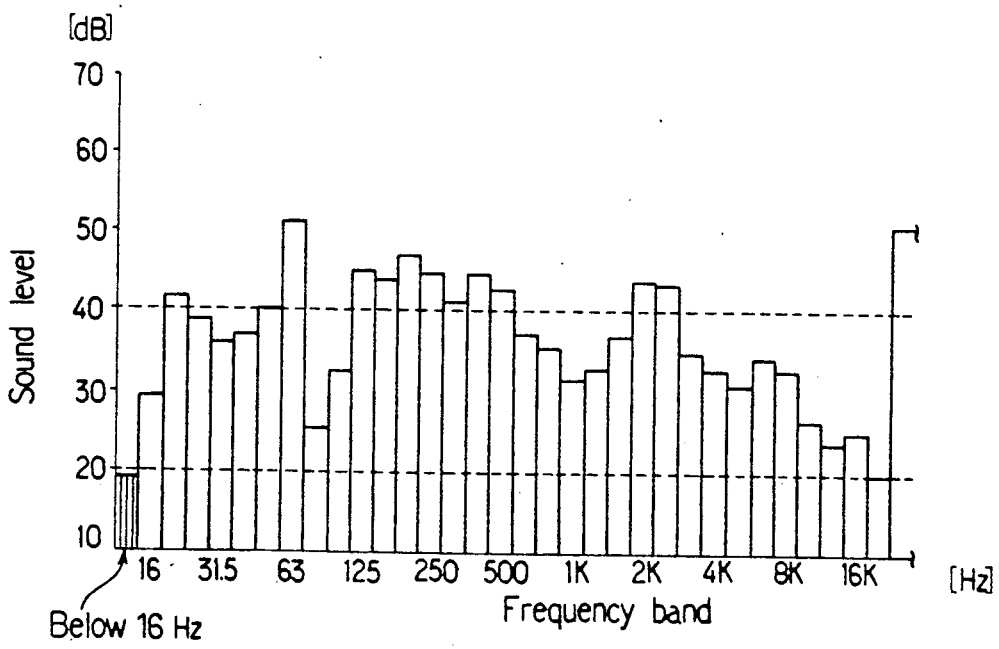
FIG. 10 is a view similar to FIG. 9 while the refrigerant is leaking.

On the other hand, the sound level is increased in the frequency band of 500 Hz or above in the refrigerant leakage condition as compared in the refrigerant non-leakage condition, from comparison of the measured frequency characteristics in FIG. 10 with the reference frequency characteristics in FIG. 9 where the refrigerant is not leaking. Such increase in the sound level is considered to result from the following reason: frictional forces of components of compressor 8 is increased since a lubricating oil in the compressor becomes short owing to the refrigerant leakage or the pressure of refrigerant compressing blades of compressor 8 is reduced owing to the refrigerant leakage and the blades are caused to chatter, which has some affection with pulsation of the refrigerant sucked from compressor 8. This confirms the fact that a major component of the noise in the frequency characteristics band from 500 Hz to 2 KHz is a pulsation sound produced by the refrigerant recirculated through the refrigerating cycle. A major component of the noise in the frequency characteristics band below 500 Hz is the noise produced by compressor 8 itself during drive thereof and particularly, affected by the rotational speed of compressor 8 and the frequency characteristics obtained by multiplying the power supply frequency by any integer. Furthermore, the noise produced by compressor 8 is transferred to the components of the refrigerator such as the cabinet, compressor base, vaporizing pan support and piping and produced as a secondary sound which also affects the frequency band below 500 Hz. On the other hand, the frequency band of 2 KHz or above of the noise produced with drive of compressor 8 results from sound produced owing to the sliding of mechanical parts of compressor 8.

When determining that fan 6 is in the undesired or abnormal condition as the result of comparison of the measured frequency characteristics with each of the reference frequency characteristics the data of which is stored in storage means 17, at step J, opposite-phase sound producing circuit 14 advances to step K where it generates alarm signal Pb. In response to alarm signal Pb, speaker 13 produces a pipping sound and accordingly, a person around the refrigerator perceives the alarming sound and recognizes that fan 6 has been locked. Consequently, a quick measure may be taken against the locking of fan 6 to prevent food in the refrigerator from being rotten even when the refrigerator storage compartment atmosphere is not sufficiently cooled owing to the locking of fan 6.

When determining that fan 6 has not been locked, at step J, opposite-phase sound producing circuit 14 advances to step L where measured frequency characteristics is compared with the reference frequency characteristics the data of which is stored in the storage means 17, thereby determining whether or not the refrigerant is leaking. When determining that the refrigerant is leaking, opposite-phase sound producing circuit 14 produces alarm signal Pc at step N. Since the pipping sound is produced by speaker 13, the person around the refrigerator perceives the alarming sound and confirms that the refrigerant is leaking. Consequently, a quick measure may be taken against the refrigeration leakage.

Furthermore, when determining at step L that the refrigerant is not leaking, opposite-phase sound producing circuit 14 advances to step N where alarm signal Pd is generated. In response to alarm signal Pd, speaker 13 produces the peeping sound. Consequently, it is recognized that thermistor 19 has been in the abnormal condition and the measure may be taken. Since opposite-phase sound producing circuit 14 has already determined that the long period operation of compressor 8 does not result from the locked condition of fan 6 nor the refrigerant leakage, it determines that thermistor 19 has been in the abnormal condition. Opposite-phase sound producing circuit 14 is in the standby mode at step O until a reset button has been operated, opposite-phase sound producing circuit 14 operates to interrupt output of the alarm signals at step P.

When the temperature of freezing compartment 2 is sufficiently decreased such that drive signal Sa is not generated by comparator 20, opposite-phase sound producing circuit 14 advances from step E to step Q where output of control signal Pa is interrupted. Consequently, even though compressor 8 is intermittently driven in accordance with the temperature of freezing compartment 2, the noise control is not performed when drive of compressor 8 is interrupted, thereby avoiding purposeless execution of the noise control.

In the foregoing embodiment, control means 16 is allotted steps B, C, D, I, J, K, L, M, N, O and P and processor 15 is allotted steps A, E, F, G, H and Q.

As obvious from the foregoing, opposite-phase sound producing circuit 14 comprises processor 15 for the noise reduction control based on the signal generated by microphone 12 and control means 16 for determining any one or more of the refrigerating cycle constituent elements in the undesired or abnormal condition, based on the noise received by microphone 12. Consequently, a new function of detecting one or more refrigerating cycle constituent elements in the abnormal condition may be added by utilizing microphone 12 provided for the noise reduction control. Accordingly, since provision of an exclusive circuit for detecting the abnormal condition in the refrigerating cycle may not be required, the overall circuit arrangement may be prevented from being complicated although the new function is added.

Since machine compartment 7 communicates to the outside through ventilating opening 11*a*, the temperature of machine compartment 7 is not abnormally increased owing to heat generated by compressor 8 during its drive. Furthermore, since machine compartment cover 11 is formed from a material having fine thermally conductive property, the ventilating capacity for the heat generated in machine compartment 7 may be improved with the result that the increase in the temperature of machine compartment 7 may be lowered.

Although the noise frequency bands are compared at every ⅓ octave in the case of comparing the measured frequency characteristics with the reference frequency characteristics in the foregoing embodiment, the noise frequency bands having large level differences may be compared, instead. Furthermore, the measure frequency characteristics may be compared with the reference frequency characteristics based on cumulative differences of signal levels of specific frequency bands or signal level difference of the whole frequency band. Furthermore, the measured frequency characteristics may be compared with the reference frequency characteristics based on waveform patterns of the signals produced in accordance with the noise received by microphone 12 or by way of combination of the above-described methods.

Although the alarm sound is produced by speaker 13 in the foregoing embodiment, speech may be reproduced from speaker 13 by way of a tape recorder or sound synthesis technique, instead. More specifically, when the locked condition of fan 6 is detected, speaker 13 may produce speech denoting that "There is a possibility that the fan is not being driven. Please make contact with a service man after confirming that the door is completely closed." When the refrigerant leakage is detected, speaker 13 may produce speech denoting that "There is a possibility that the refrigerant is leaking. Please make contact with a service man after confirming that the door is completely closed." When the abnormal condition of thermistor 19 is detected, speaker 13 may produce speech denoting that "There is a possibility of failure of the thermistor. Please make contact with a service man after confirming that the door is completely closed."

Although the invention has been applied to the household refrigerator in the foregoing embodiment, it may be applied to other refrigeration systems such as an outdoor unit of a room air conditioner or a refrigerative display case.

The foregoing disclosure and drawings are merely illustrative of the principles of the present invention and are not to be interpreted in a limiting sense. The only limitation is to be determined from the scope of the appended claims.

What we claim is:

1. A silencer for refrigeration system including an outer cabinet having a compartment, and evaporator for evaporating a refrigerant, a compressor disposed in the compartment for compressing the refrigerant discharged from the evaporator, the compressor being driven by a motor enclosed therein, and a condenser for condensing the high pressurized refrigerant gas discharged from the compressor, the silencer comprising:

A) a noise deadening section comprising:

a) noise detecting means for detecting noise produced by the compressor and converting the noise to a corresponding electrical signal;

b) signal converting means for converting the electrical signal generated by the noise detecting means to a corresponding sound wave signal suitable for deadening the noise from the compressor by the effect of the sound wave interference; and c) a sound producer driven in response to the sound wave signal generated by the signal converting means such that the sound is directed to the interior of the compartment;

B) an abnormal condition determining section comprising:

a) storage means for previously storing compressor noise pattern data indicative of compressor noise when the refrigeration system is operating abnormally as reference patterns; and b) recognition means for comparing the electrical signal generated by the noise detecting means with previously stored data stored in the storage means, thereby recognizing abnormal operation of the refrigeration system;

C) means for generating a drive signal indicating that the compressor is in operation;

D) first means for monitoring the condition of the refrigeration system while being supplied with the drive signal; and E) second means for maintaining operation of the noise deadening section while it is determined by the first means that the refrigeration system is operating normally, the second means activating the abnormal condition determining section when it is determined by the first means that the refrigeration system is operating in an abnormal manner.

2. A silencer according to claim 1, wherein the noise detecting means comprises a microphone.

3. A silencer according to claim 1, wherein the noise detecting means comprises a device for picking up the vibration of the compressor.

4. A silencer according to claim 1, wherein the data of reference patterns includes data of the amplitude values of the noise in predetermined noise frequency ranges.

5. A silencer according to claim 1, wherein the data of reference patterns includes data of the accumulated amplitude values of the noise in predetermined noise frequency ranges and the comparing means accumulates the amplitudes of the signals generated by the noise detecting means, the signals corresponding to the frequency ranges of the reference pattern, thereby comparing the accumulated amplitude value with the reference noise pattern.

6. A silencer according to claim 1, wherein the compressor compartment is defined by ceiling, bottom, side, front and rear walls and one of dimensions of the depth, width and height of the compressor compartment has a value larger than the other two such that a standing wave of sound to be deadened is composed only in the direction of said one dimension having the value larger than the other two.

7. A silencer according to claim 6, wherein the compartment has a ventilating opening formed in at least one of the walls of defining the compartment and the ventilating opening is formed into a generally slenderly rectangular shape so as to longitudinally intersect the direction in which the standing wave of the sound travels in the compartment.

8. A silencer according to claim 1, wherein the refrigeration system further includes fan means for directing air to the circumference of the evaporator and a temperature sensor for sensing the temperature of the evaporator or the circumference thereof.

9. A silencer according to claim 6, wherein the data of the reference patterns includes data of noise patterns of the compressor in the case where the refrigerant has leaked out.

10. A silencer according to claim 6, wherein the data of the reference patterns includes data of noise patterns of the compressor in the case where the fan means has stopped.

11. A silencer according to claim 6, wherein the data of the reference patterns includes data of noise patterns of the compressor in the case where the temperature sensor has been in an abnormal state.

12. A silencer according to claim 1, wherein the first means comprises timer means activated in response to the drive signal and the second means comprises means for maintaining the noise deadening section in operation for a predetermined period in which the drive signal is present with a period set to the timer means and means for activating the abnormal condition determining means in response to presence of the drive signal even after expiration of the period set to the timer means.

* * * * *